US006145500A

United States Patent [19]

Westerlund

[11] Patent Number: 6,145,500

[45] Date of Patent: Nov. 14, 2000

[54] HEATING DEVICE

[76] Inventor: Sven-Erik Westerlund, Industrivage 5 914 63, Norrfors, Sweden

[21] Appl. No.: 09/433,107

[22] Filed: Nov. 3, 1999

[51] Int. Cl.[7] ..... F24D 9/00

[52] U.S. Cl. ..... 126/101; 126/67; 126/77; 126/80; 126/290

[58] Field of Search ..... 126/101, 77, 83, 126/65–67, 367, 368, 60, 80, 61, 290; 122/15, 20 B; 237/8 R, 56

[56] References Cited

U.S. PATENT DOCUMENTS

| | | | |
|---|---|---|---|
| 4,299,178 | 11/1981 | Wilson . | |
| 4,461,242 | 7/1984 | Black | 126/101 |
| 4,640,458 | 2/1987 | Casier et al. . | |
| 4,700,686 | 10/1987 | Woo | 122/15 |
| 4,724,798 | 2/1988 | Alspaugh | 126/101 |
| 4,766,876 | 8/1988 | Henry et al. | 126/77 |
| 4,779,795 | 10/1988 | Winmill | 126/101 |
| 5,113,843 | 5/1992 | Henry et al. | 126/77 |
| 5,303,693 | 4/1994 | Schroeter et al. . | |

*Primary Examiner*—James C. Yeung
*Attorney, Agent, or Firm*—Fasth Law Offices; Rolf Fasth

[57] ABSTRACT

The heating device has a housing and a liquid containing compartment defined inside the housing. A heating chamber is disposed inside the housing and the compartment. A fire chamber is disposed inside the heating chamber that produces hot combustion gases. A separation channel is defined between an outer wall of the fire chamber and the outer wall of the heating chamber for conveying the air from the first air inlet into the heating chamber. The separation channel also creates an important insulation between the fire chamber and the compartment so that the combustion material in the fire chamber burns at a sufficiently high temperature to prevent the formation of tar accumulations on the inside walls of the various ducts. Also, the separation channel maintains a suitable temperature of the outer wall of the fire chamber to reduce the risk of cracking and to prolong the useful product life of the fire chamber.

13 Claims, 3 Drawing Sheets

HEATING DEVICE

TECHNICAL FIELD

This invention relates to heating device that is heated by flue gases.

BACKGROUND AND SUMMARY OF THE INVENTION

Many attempts have been made to improve the heating efficiency of various heating devices for houses. Particularly in cold climates it is important to provide efficient heating for reasons of heat economy and environmental protection. Many houses have conventional fire places that are very inefficient because oxygen in the warm air inside the house is used for the fire so that the warm air is sucked from the room to feed the fire and out through the chimney. The use of conventional fire places is therefore limited as a source for heating houses.

Glazed tile stoves are more efficient because the oxygen for the fire may be taken from the outside air. However, when the logs have burnt up, the stoves only remain sufficiently warm for a relatively short period and require an on-going fire to provide sufficient heating.

Most conventional heating device are constructed so that there is a direct contact between the fire chamber and the body of the heating device. This direct contact often reduces the useful life of the heating device due to excessive cracking. If the heating device contains water, the direct contact with the fire chamber may cause the water to boil that, in turn, could lead to catastrophic results. Another problem with conventional heating devices is that they have a tendency to burn at a temperature that is too low or too low that may result in tar accumulations in the various smoke diverting channels and ducts.

The heating device of the present inventions solves the above mentioned problems. The heating device has a housing and a liquid containing compartment defined inside the housing. A heating chamber is disposed inside the housing and the compartment. A fire chamber is disposed inside the heating chamber that produces hot combustion gases. A separation channel is defined between an outer wall of the fire chamber and the outer wall of the heating chamber for conveying the air from a first air inlet into the heating chamber. The separation channel also creates an important insulation between the fire chamber and the compartment so that the combustion material in the fire chamber burns at a sufficiently high temperature to prevent the formation of tar accumulations on the inside walls of the various ducts. Also, the separation channel maintains a suitable temperature of the outer wall of the fire chamber to reduce the risk of cracking and to prolong the useful product life of the fire chamber.

DETAILED DESCRIPTION

Figure 1:
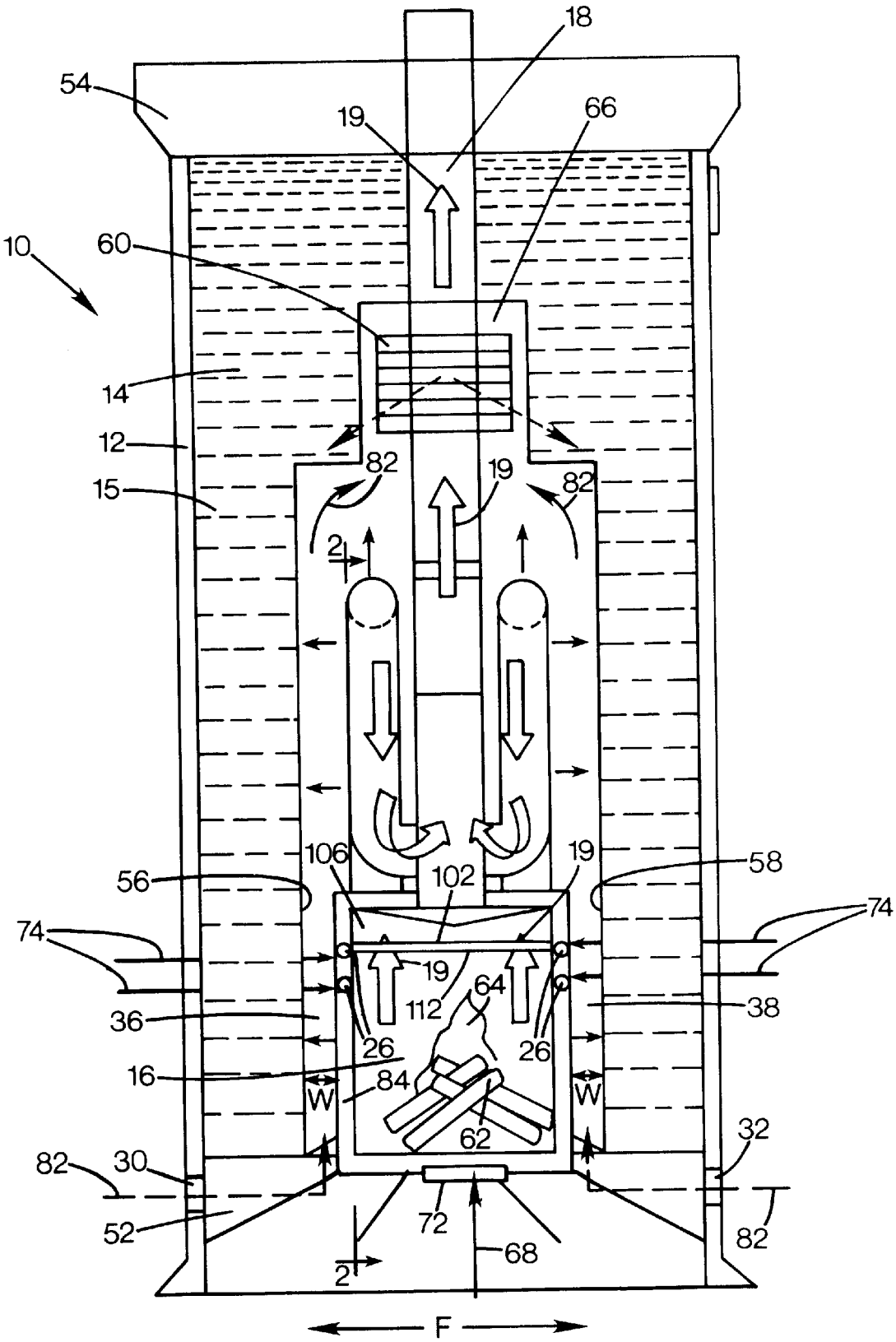
FIG. 1 is a cross-sectional front view of the heating device of the present invention.

With reference to FIGS. 1–4, a heating device 10 has a housing 12 that may be about 8 feet high to suitably fit between a ceiling and a floor of a conventional room in a house. Of course, the housing may be higher or lower, as desired. The housing may be made of tile, brick, marble or any other suitable wall material.

Preferably, a compartment 14 is defined inside the housing for storing a liquid 15, such as water or any other suitable fluid or liquid. The compartment 14 may contain between about 260–700 liters of water. As explained below, the liquid 15 may be used to store excess heating energy for increasing the efficiency of the heating device 10.

A water tight heating chamber 50 is disposed inside the housing 12 so that the liquid 15 almost surrounds the heating chamber 50. The liquid 15 extends from a bottom 52 to a top 54 of the housing 12. The liquid 15 is confined by a left side wall 56 and a right side wall 58 of the heating chamber 50 (see FIG. 1). The heating chamber 50 extends to about ⅔ of the total height of the housing 12. At an upper end of the heating chamber 50, a heating outlet 60 is defined that is facing a front side 61 of the housing 12.

At a bottom of the housing 12 is a fire chamber 16 that has openable and closeable front doors 112 so that logs 62 may be placed inside the fire chamber 16. The logs 62 may be lit to start a fire 64 in the fire chamber 16. The fire chamber 16 is in fluid communication with a central vertical flue channel 18 that extends upwardly through the housing 12 and into a chimney (not shown).

The hot smoke or combustion gases from the fire 64 (marked with arrows 19) may move directly into the channel 18 via a channel 20 (see FIG. 3) or via a curved channel 22 (see FIG. 2) that is shaped like an upside down U. The path of the hot smoke may be selected by opening or closing an opening 21 of the channel 20 with a closure device 24 that is slidably attached at a top end of the fire chamber 16. The closure device 24 has a handle 25 that may be pushed into the housing 12 to close the channel 20 and pulled out to open the channel 20. Before entering into the chamber 66 and then exiting through the opening 60, the air 82 may also be heated by the walls of the central channel 18. In this way, the air that exits the opening 60 is warm to heat the outside room. The air 82 is heated by convection from the ducts. The air 82 in turn may be used to heat the liquid 15, especially when the outlet 60 is closed, as described below.

The channel 20 is used when it is important to establish the proper draft in the chimney and to remove any moisture and other undesirable from the flue channel 18. The direct pathway through the channel 20 is often used when the heating device 10 has not been used for a while or the chimney is very cool so that there is not enough pressure and draft in the flue channel 18 and inside the chimney. The direct channel 20 does not provide much heating of the room outside the heating device 10.

When condensation has been removed from the chimney and a sufficient draft has been established, the closure device 24 may be pushed in to close the channel 20. If it is desirable to quickly heat up a room, the opening 60 should be opened to permit the air 82 to flow out into the room to be heated. The air 82 may hold a temperature of about 400–500° C. when the air flows out of the outlet 60. By keeping the opening 60 open, very little of the air 82 is used to heat the liquid 15 through convection.

When the room is relatively warm, the opening 60 may be partially or completely closed so that the air 82 is heated through convection by the hot smoke 19 flowing in the channel 22. The heated air 82 in turn heats the walls 56, 58 and the liquid 15 in the compartment 14 is also heated. When the opening 60 is closed, about 80% of the heat energy transferred to the air 82 is transferred to the liquid 15. The remaining 20% or so is used to heat the room directly.

After a couple of hours of heating the liquid 15, the whole heating device 10 may be hot so that the heating device 10 may continue heating the room although there is no fire 64. In other words, the liquid 15 may be used to store heat energy that may be used after the fire 64 has been extinguished. Excess heat may also be transferred to a heat exchanger or a conventional radiator that is remotely disposed from the heating device 10.

Primary air 68 for the fire 64 may be supplied through an opening 28 defined at the front side 61 of the housing 12. Preferably, the opening 28 is disposed at the very bottom of the housing 12 adjacent a floor 70 of the fire chamber 16. A slidable closure mechanism 72 is in operative engagement with the opening 68 for closing and opening the opening 68.

Secondary air 74 may be supplied through two openings 26 also defined at the front side 61 but above the opening 28. The openings 26 may have a diameter of about 10 millimeters. Preferably, the openings 26 are disposed slightly above the fire 64. The openings 26 are in fluid communication with upwardly sloping channels 76 that extends from the front side 61 and across the fire chamber 61 to a back wall 78 of the fire chamber 16. The channels 76 has plurality of openings 80 defined therein so that the secondary air 74 may enter into the fire chamber 16 slightly above the fire 64. For example, the channels 76 may have four openings 80 defined therein that have a diameter of about 8 millimeter. The air 74 provides the extra air that is needed to completely burn the logs 62 and acts as an after-burner.

When the flame from the fire 64 flows around the channels 76, the fire 64 is exposed to the extra oxygen that flows out of the openings 80 to burn any uncombusted gases 19 from the fire 64. In a typical fire of logs, the logs 62 are combusted to about 80% and the remaining 20% is converted to uncombusted gases. By exposing the uncombusted gases to the oxygen in the channel 76, the combustion is almost 95% complete.

Figure 2:
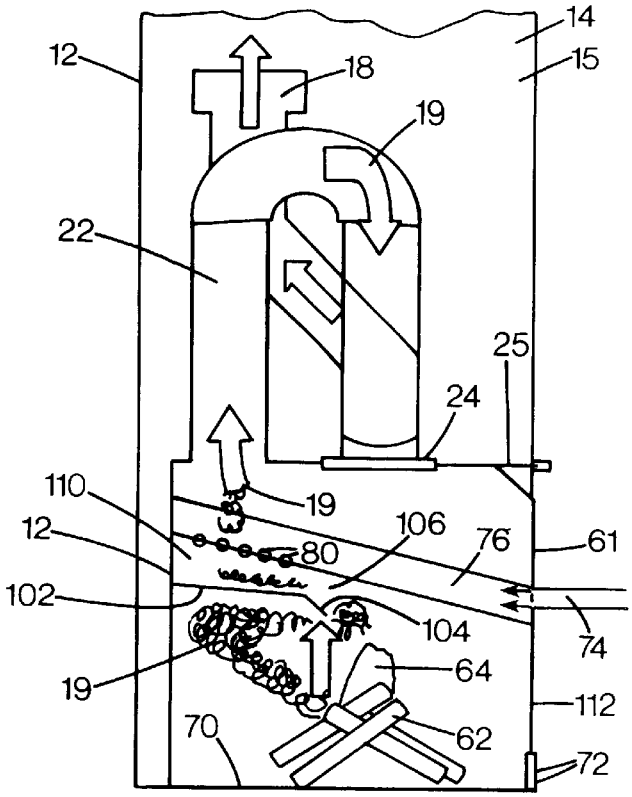
FIG. 2 is a cross-sectional side view along line 2—2 of the heating device in FIG. 1 showing the flow of the flue gases.
Figure 3:
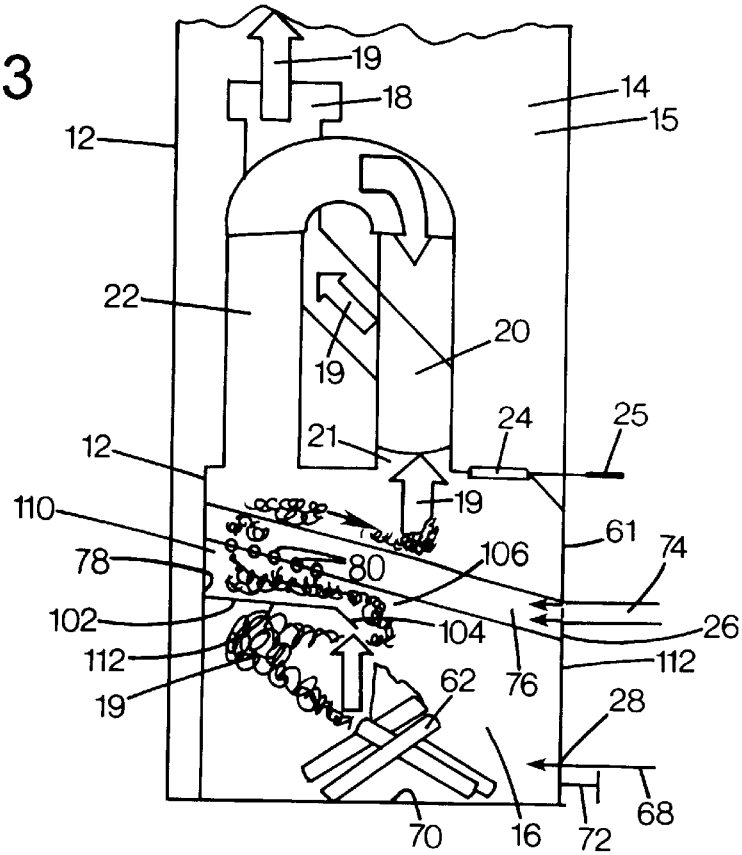
FIG. 3 is a cross-sectional side view along line 2—2 of the heating device in FIG. 1 showing the flow of the flue gases.

The air 82 to be heated by the combustion in the fire chamber 16 may enter through side openings 30, 32 defined at the bottom 52 of the housing 12. The air 82 then enters a pair of relatively narrow channels 36, 38 defined between the walls 56, 58, respectively, and an outer wall 84 of the fire chamber 16. During the narrow passage in the channels 36, 38, the air 82 is heated by the outer wall 84. When the smoke 19 is circulated through the channel 22, as shown in FIG. 2, the air 82 is also heated by the hot smoke 19 by being in contact with the hot walls of the channel 22.

One important feature of the present invention is that there is no direct contact between the compartment 14 and the fire chamber 16 because they are separated by the channels 36, 38. Instead, the air 82 that is flowing in the channels 36, 38 is heated by the heat of the smoke 19 flowing in the channels 18, 20, 22. The smoke 19 also indirectly heats up the liquid 15 contained in the compartment 14 to about 50–60° C. without being in direct contact with the compartment 14. The indirect contact between the compartment 14 and the fire chamber 16 enables a burning at a higher temperature in the fire chamber 16 because a direct contact with the cool wall of the compartment 14 would cool the air temperature in the fire chamber 16 too much to maintain a very high efficiency. The higher burning temperature of the fire 64 reduces the amount of tar that may be formed on the inner walls of the various channels and inside the fire chamber 16 itself. Finally, the indirect reduces the risk of the water boiling which may have catastrophical consequences.

Figure 4:
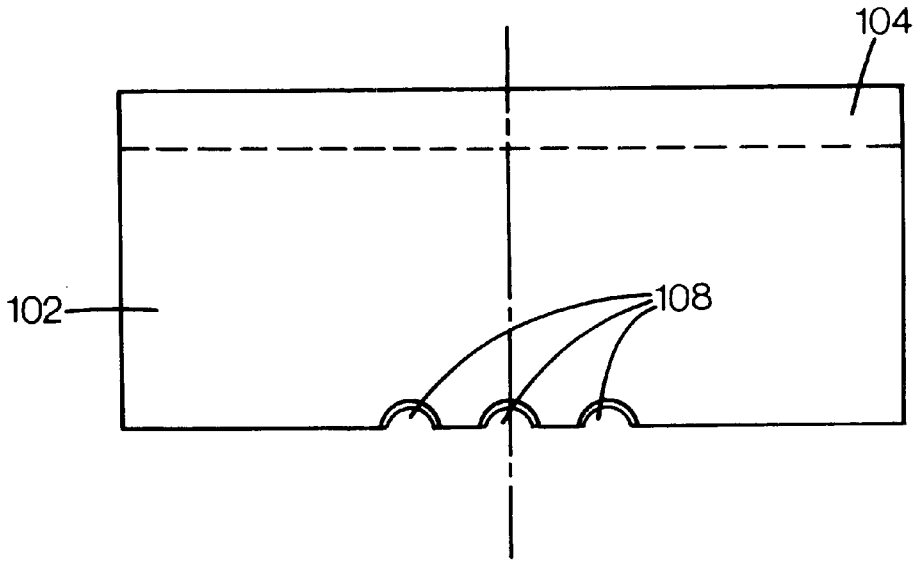
FIG. 4 is a detailed top view of a smoke diverting sheet disposed inside the fire chamber of the heating device.

FIG. 4 shows an important detail of the present invention. A sheet 102 extends horizontally outwardly from the wall 78 of the fire chamber 16. The sheet 102 extends across the entire width F of the fire chamber 16. The sheet 102 has a downwardly angled outer edge portion 104. The sheet 102 is disposed below the channel 76 so that a relatively narrow gap 106, that is about 70–80 millimeters, is formed between the sheet 102 and an outside bottom wall of the channel 76. In the gap 106, the smoke 19 is exposed to the oxygen 74 that was injected in the openings 26 to after burn any uncombusted gases in the smoke 19. The smoke 19 then either enters into the channel 22 or channel 20 depending upon if the channel 22 is open or not.

Immediately adjacent the wall 78, the sheet 102 defines a plurality of openings or cavities 108 in a mid-section of the sheet 102. An important function of the openings 108 is to create an under-pressure in a chamber 110 that is formed above the sheet 102. The pressure in the chamber 110 should be lower than the pressure in the fire chamber 16. This under-pressure in the chamber 110 is a result of the under-pressure that exist in the channels 20, 22 and in the chimney itself. The under-pressure in the chamber thus sucks the smoke 19 in the direction of the cavities 108 and the back wall 78.

However, the cavities 108 are small enough not to let a substantial amount of smoke therethrough so that the smoke follows an underside 112 of the sheet 102 and around a tip of the edge portion 104 and in through the gap 106 also due to the under pressure created in the ducts 18, 20, 22. The cavities 108 are located in the middle of the sheet 102 so that the smoke 19 does not flow directly into the channels 20, 22 without being exposed to the oxygen 74. In the gap 106 and in the chamber 110, the smoke encounters the oxygen 74 that flows out through the openings 80 to combust any uncombusted gas in the smoke 19. The edge portion 104 increases the distance of travel for the smoke 19 to make sure there is no burning substances in the smoke. It is also important not to make the sheet 102 to long so that the glass doors 112 that close in the fire chamber 16 are exposed to the hot smoke 19 that flows around the sheet 102 because the hot smoke may blacken the glass doors.

Figure 5:
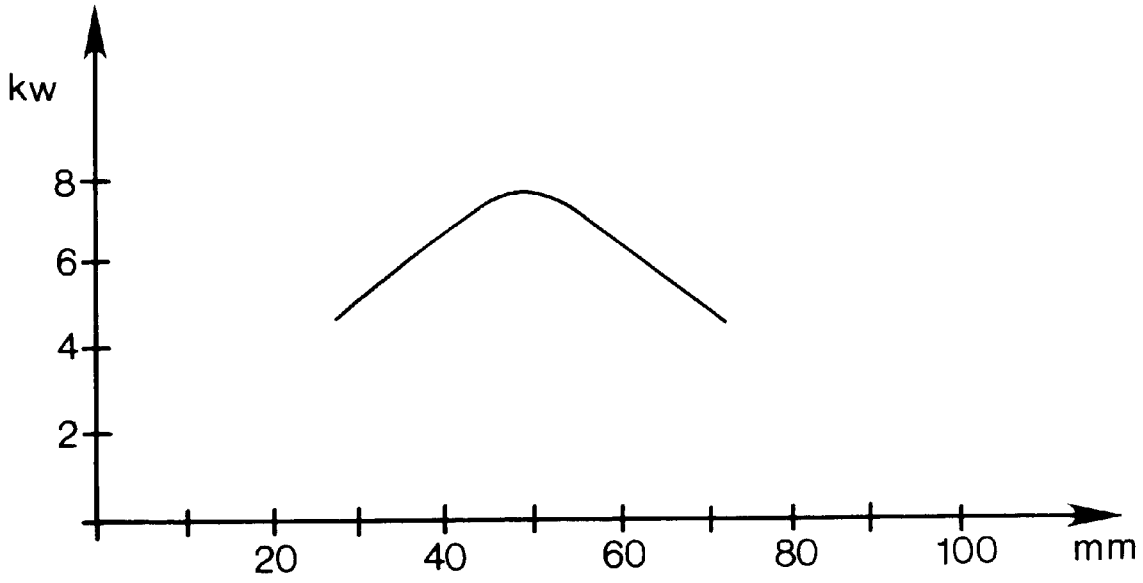
FIG. 5 is a schematic graph showing the correlation between the width of a separation channel and the output of the heating device.

FIG. 5 shows the relationship between the width of the channels 36, 38 and the overall output of the heating device. The channels 36, 38 should be about 30–70 millimeter, more preferably about 50 millimeters wide. If the channels are less than 30 millimeters the liquid 15 has a tendency to cool the wall of the fire chamber too much that in turn reduces the efficiency of the combustion. Also, the combustion tends to create more tar deposits on the inside of the exhaust channels and more ashes from the logs. If the channels are wider than 70 millimeters, then the walls of the fire chamber tend to get too hot that reduces the useful life of the fire chamber because the walls tend to crack over time. In other words, the liquid 15 cannot cool the fire chamber properly if the channels 36, 38 are too wide. The ideal combustion temperature in the fire chamber should be between 650–700° C. Temperatures above 700–750° C. has a negative effect on the durability of the fire chamber. Similarly, temperatures lower than 600° C. reduces the combustion efficiency as mentioned above.

It has been found that an output of almost 8 kW may be achieved by using a channel width W of about 50 millimeters. In the preferred embodiment, the width of the channel is between about 40 and about 60 millimeters. More preferred, the width W is between about 45 and about 55 millimeters. The wall 78 is usually made of a fire resistant material such as brick or concrete. If the width W is greater than about 60 millimeter, the temperature in the fire chamber may exceed 700° C., which, as mentioned above, has a negative effect on the life of the fire chamber. If the width W is smaller than 40 millimeters, the temperature in the fire chamber is below 600° C. which results in inefficient burning of the logs 62.

Another important feature of the present invention is that the liquid 15 may be conducted away from the heating device 10 to warm other areas, such as radiator located in another room, while the logs 62 are burning in the heating device. The heating device 10 may also be connected to a heat exchanger.

While the present invention has been described in accordance with preferred compositions and embodiments, it is to be understood that certain substitutions and alterations may be made thereto without departing from the spirit and scope of the appended claims.

I claim:

1. A heating device, comprising:

a housing;

a compartment defined inside the housing, the compartment containing a liquid;

a heating chamber disposed inside the housing and the compartment, the heating chamber having an outer wall;

a fire chamber disposed inside the heating chamber, the fire chamber producing hot combustion gases;

the housing defining a first air inlet and a first air outlet that are in fluid communication with the heating chamber for permitting air, to be heated, to enter into the heating chamber through the first air inlet and to exit the heating chamber through the first air outlet;

a separation channel defined between an outer wall of the fire chamber and the outer wall of the heating chamber for conveying the air from the first air inlet into the heating chamber;

the housing defining a first oxygen opening in fluid communication with the fire chamber;

a curved duct disposed inside the heating chamber and in fluid communication with the fire chamber to convey the hot combustion gases away from the fire chamber, the curved duct in operative engagement with the air disposed inside the heating chamber to conduct heat from the hot combustion gases flowing therein to the air disposed inside the heating chamber to heat the air; and a flue gas channel defined in the housing, the flue gas channel being in fluid communication with the curved duct to convey the hot combustion gases from the curved duct, the hot combustion gases being separate from the heated air.

2. The heating device according to claim 1 wherein the separation channel has a width of between about 45 millimeters and 55 millimeters.

3. The heating device according to claim 1 wherein the separation channel has a width of about 50 millimeters.

4. The heating device according to claim 1 wherein a secondary air channel extends from a front wall to the back wall of the fire chamber.

5. The heating device according to claim 4 wherein the secondary air channel has a plurality of openings defined therein.

6. A heating device, comprising:

a housing;

a compartment defined inside the housing, the compartment containing a liquid;

a heating chamber disposed inside the housing and the compartment, the heating chamber having an outer wall;

a fire chamber disposed inside the heating chamber, the fire chamber producing hot combustion gases, the fire chamber having a back wall;

the housing defining a first oxygen opening in fluid communication with the fire chamber;

a sheet attached to the back wall of the fire chamber and perpendicularly protruding therefrom, the sheet extending across a width of the fire chamber;

a curved duct disposed inside the heating chamber and in fluid communication with the fire chamber to convey the hot combustion gases away from the fire chamber; and a flue gas channel defined in the housing, the flue gas channel being in fluid communication with the curved duct to convey the hot combustion gases from the curved duct.

7. The heating device according to claim 6 wherein the sheet defines a plurality of cavities immediately adjacent the back wall of the fire chamber.

8. The heating device according to claim 6 wherein the sheet has an downwardly protruding outer edge to divert the hot combustion gases in a downward direction.

9. The heating device according to claim 1 wherein a fresh air channel extends across the fire chamber from a front wall to a back wall of the fire chamber.

10. The heating device according to claim 9 wherein the fresh air channel has a plurality of openings defined therein.

11. A method of heating, comprising:

(a) providing a heating device having a liquid containing compartment and a fire chamber disposed therein, the fire chamber having a perpendicularly protruding sheet attached to a back wall of the fire chamber and a fresh air channel extending across the fire chamber;

(b) conveying air through a separation channel, defined between the fire chamber and compartment, into the fire chamber;

(c) combusting a material disposed in the fire chamber;

(d) producing a hot combustion gas in the fire chamber;

(e) creating an under pressure in a chamber defined above the sheet; and (f) conveying the hot combustion gas into an area below the sheet adjacent the back wall and outwardly around an outer tip edge of the sheet and into a gap defined between the sheet and the fresh air channel.

12. The method according to claim 11 wherein the method further comprises exposing the hot combustion gas to a fresh air in the gap, the fresh air is conveyed in the fresh air channel.

13. The method according to claim 12 wherein the method further comprises combusting any uncombusted gas contained in the hot combustion gas.

* * * * *